US006511206B1

(12) United States Patent
Fan Wong

(10) Patent No.: US 6,511,206 B1
(45) Date of Patent: Jan. 28, 2003

(54) FOLDABLE DECORATIVE LIGHT

(76) Inventor: Tsui-Tuan Fan Wong, 15th Fl., No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 0 days.

(21) Appl. No.: 10/017,948

(22) Filed: Dec. 7, 2001

(51) Int. Cl.[7] ..... F21S 4/00
(52) U.S. Cl. ..... 362/250; 362/249; 362/806
(58) Field of Search ..... 362/249, 250, 362/227, 252, 806, 807, 121, 240

(56) References Cited

U.S. PATENT DOCUMENTS 6,186,645 B1 * 2/2001 Camarota ..... 362/249
6,217,194 B1 * 4/2001 Huang ..... 362/249
6,244,726 B1 * 6/2001 Fan Wong ..... 362/249
6,265,834 B1 * 7/2001 Lin ..... 362/249
6,394,623 B1 * 5/2002 Tsui ..... 362/252
6,428,342 B1 * 8/2002 Pan ..... 362/252

* cited by examiner

*Primary Examiner*—Laura Tso
(74) *Attorney, Agent, or Firm*—Pearne & Gordon LLP

(57) ABSTRACT

A decorative light includes a length of flexible core provided with bulbs and wires electrically connected to the bulbs, and a substantially transparent outer covering encasing the core. In addition, a slot is longitudinally defined in the core and having a resilient member received in the slot. With the addition of the resilient member, the decorative light is able to be folded to any shape.

1 Claim, 3 Drawing Sheets

FOLDABLE DECORATIVE LIGHT

BACKGROUND OF THE INVENTION

1. Field of the Invention

The present invention relates to a decorative light, and more particularly to a foldable light which can be bent to form any shape.

2. Description of Related Art

Decorative lights having a plurality of bulbs arranged in a length of a flexible core are known. In such a light, the flexible core is directly covered with a transparent outer covering that is integrally formed outside of the flexible core. Although the covering-is also made of a flexible material and the user of the decorative light is able to fold the decorative light into any form and shape, the flexible material of the decorative light tends to return to its original shape after the user let go of the decorative light. Therefore, without other support, the decorative light is not able to be held in a certain shape even though the shape increases the attraction of the viewers dramatically.

Therefore, it is an objective of the invention to provide a foldable decorative light to mitigate and/or obviate the aforementioned problem.

SUMMARY OF THE INVENTION

The object of the present invention is to provide a foldable decorative light which can provide a fancy decoration.

In order to accomplish the foregoing objective, the decorative light of the invention has a longitudinal slot defined through the decorative light and a resilient member received in the slot. With the resilient member received in the slot, the decorative light is able to be formed into any shape and held in that shape.

Other objects, advantages and novel features of the invention will become more apparent from the following detailed description when taken in conjunction with the accompanying drawings.

DETAILED DESCRIPTION OF THE PREFERRED EMBODIMENT

Figure 1:
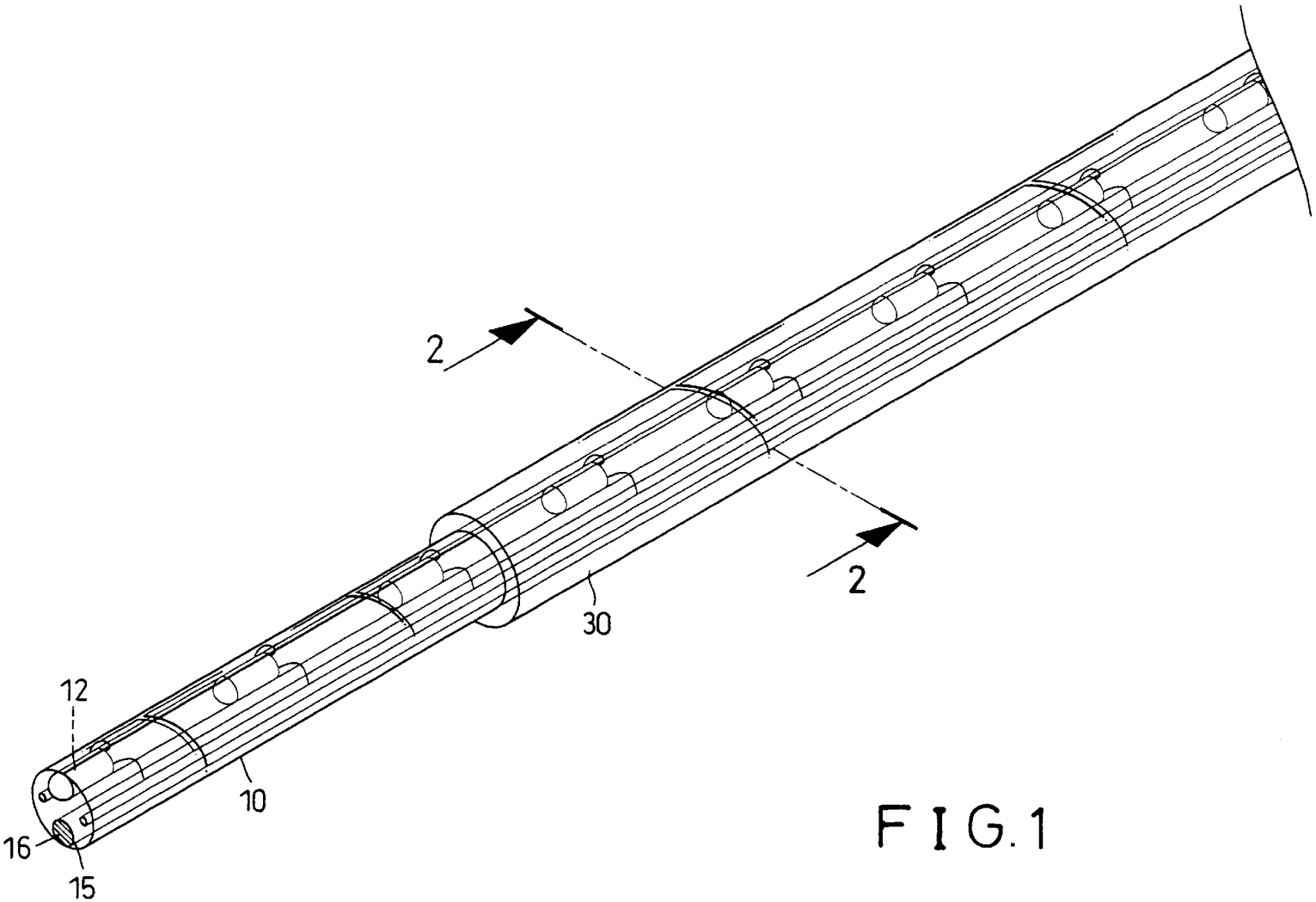
FIG. 1 is a fragmentary perspective view of the decorative light in accordance with the present invention.

With reference to FIG. 1, a decorative light in accordance with the present invention includes a length of flexible core (10) provided with bulbs (12) and wires (14) electrically connected to the bulbs (12), and a substantially transparent outer covering (30) encasing the core (10). It is well known that the outer covering (30) is integrally formed with the core (10) by injection molding so that water resistance is provided to the bulbs (12) and the wires (14).

A slot (15) is longitudinally defined in the core (10) of the decorative light. A resilient member (16), for example a metal strip, is securely inserted into the slot (15) to overcome the flexibility of the material for the outer covering (30), and the core (10). With the addition of the resilient member (16) into the decorative light, the decorative light is able to be folded into any shape and is thus able to be held in that particular shape.

Figure 2:
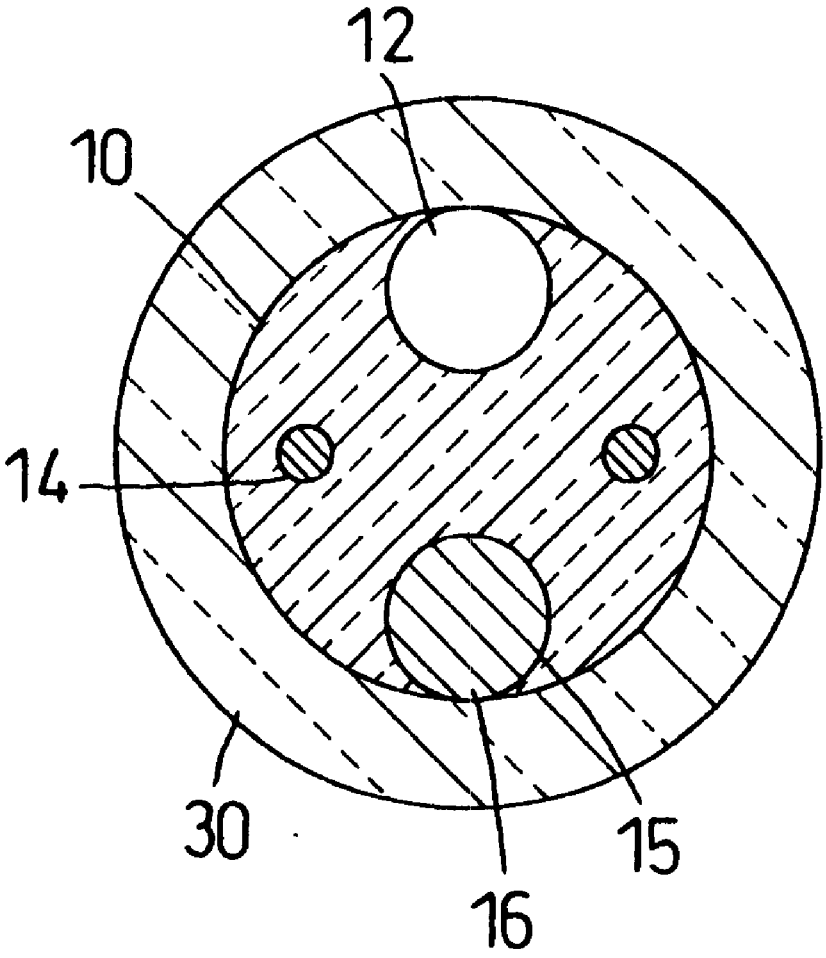
FIG. 2 is a cross sectional view of the decorative light showing the internal structure of the decorative light in FIG. 1.

With reference to FIG. 2 and still taking FIG. 1 for reference, the bulbs are spaced apart from one another so that when the resilient member (16) is folded, potential damage to the bulbs (12) is reduced to minimum. Moreover, the bulbs (12) are electrically connected to the wires (14) in parallel so that each bulb (12) is able to be lit independently.

Figure 3:
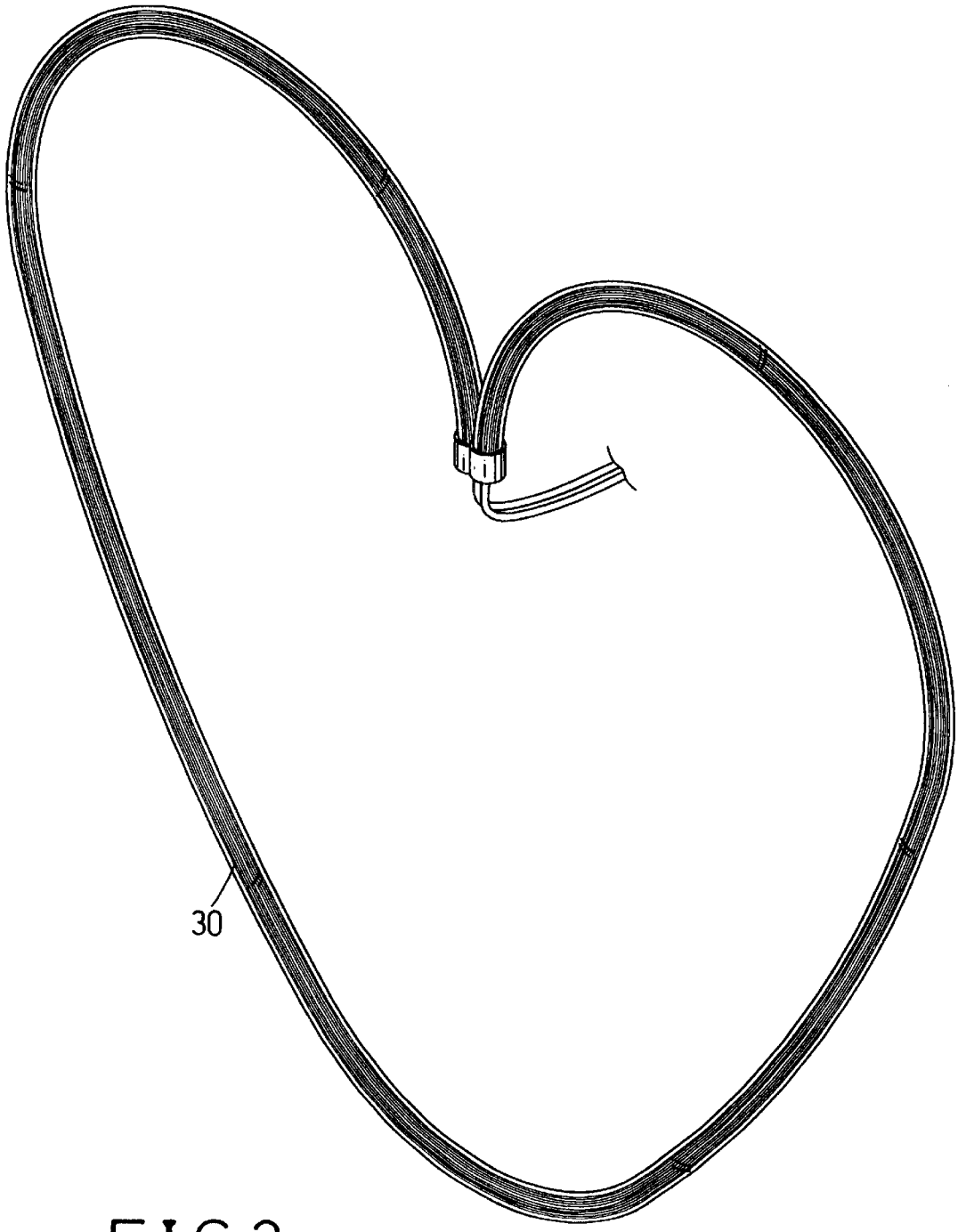
FIG. 3 is a perspective view of the application of the decorative light of the present invention, wherein the decorative light is folded into a heart shape to increase the attraction.

With reference to FIG. 3 and still taking FIG. 1 for reference, it is noted that the resilient member (16) is able to overcome the flexibility of the outer covering (30) and the core (10), so that the user is able to fold the decorative light into any shape required and that shape will be maintained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative light comprising:

a flexible core provided with bulbs and wires electrically connected to the bulbs;

a transparent outer covering encasing the core; and a slot longitudinally defined in the flexible core and having a resilient member received in the slot to all the resilience to overcome the flexibility of the core and the outer covering so that the decorative light is able to be folded into shapes.

* * * * *